US009333778B1

(12) United States Patent
Saito

(10) Patent No.: US 9,333,778 B1
(45) Date of Patent: May 10, 2016

(54) BACK TENSION MECHANISM AND ROLL MEDIUM CONVEYING DEVICE

(71) Applicant: Oki Data Corporation, Tokyo (JP)

(72) Inventor: Shinya Saito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/945,603

(22) Filed: Nov. 19, 2015

(30) Foreign Application Priority Data

Mar. 11, 2015 (JP) ..... 2015-048109

(51) Int. Cl.
*B41J 15/16* (2006.01)

(52) U.S. Cl.
CPC ..... *B41J 15/16* (2013.01)

(58) Field of Classification Search
CPC ..... B41J 33/00; B41J 33/52; B41J 15/16
See application file for complete search history.

(56) References Cited

U.S. PATENT DOCUMENTS 9,004,789 B2 * 4/2015 Sasaki ..... B41J 33/52 400/231

FOREIGN PATENT DOCUMENTS

JP 2007126230 A 5/2007

* cited by examiner

*Primary Examiner* — Sarah Al Hashimi
(74) *Attorney, Agent, or Firm* — Panitch Schwarze Belisario & Nadel LLP

(57) ABSTRACT

A back tension mechanism includes: a shaft to be connected to an axle of a medium roll; a rotation transmitting member connected to the shaft via a torque limiter and having an engaging portion; a first rotating member having a first engaged portion configured to, when the rotation transmitting member rotates in a first direction, engage with the engaging portion to receive a rotational force; a second rotating member having a second engaged portion configured to, when the rotation transmitting member rotates in a second direction opposite to the first direction, engage with the engaging portion to receive a rotational force; an urging member for urging the first rotating member in the second direction and the second rotating member in the first direction; and a base for limiting a range of rotation of the first rotating member and a range of rotation of the second rotating member.

9 Claims, 13 Drawing Sheets

BACK TENSION MECHANISM AND ROLL MEDIUM CONVEYING DEVICE

BACKGROUND OF THE INVENTION

1. Field of the Invention

The present invention relates to a back tension mechanism and a roll medium conveying device, and more particularly, to a back tension mechanism compatible with both an inward wound medium roll with a printing surface facing inward and an outward wound medium roll with a printing surface facing outward.

2. Description of the Related Art

Japanese Patent Application Publication No. 2007-126230 discloses a thermal transfer printer compatible with both an inward wound paper roll and an outward wound paper roll. The thermal transfer printer includes a roll holder for holding a paper roll, a printing unit for transferring ink onto paper from the paper roll, and a damper mechanism disposed on a paper conveying path between the roll holder and the printing unit.

SUMMARY OF THE INVENTION

An aspect of the present invention is intended to provide a back tension mechanism and a roll medium conveying device capable of applying back tension to medium drawn from a medium roll.

According to an aspect of the present invention, there is provided aback tension mechanism including: a shaft configured to be connected to an axle of a rotatably supported medium roll and rotate in synchronization with rotation of the medium roll; a rotation transmitting member connected to the shaft via a torque limiter and configured to rotate coaxially with the shaft, the rotation transmitting member having an engaging portion for transmitting rotation of the rotation transmitting member; a first rotating member rotatably supported by the shaft, the first rotating member having a first engaged portion configured to, when the rotation transmitting member rotates in a first rotational direction, engage with the engaging portion to receive a rotational force of the rotation of the rotation transmitting member; a second rotating member rotatably supported by the shaft, the second rotating member having a second engaged portion configured to, when the rotation transmitting member rotates in a second rotational direction opposite to the first rotational direction, engage with the engaging portion to receive a rotational force of the rotation of the rotation transmitting member; an urging member for urging the first rotating member in the second rotational direction and urging the second rotating member in the first rotational direction; and a base rotatably supporting the shaft, the base having a first limiting portion for limiting a range of rotation of the first rotating member and a second limiting portion for limiting a range of rotation of the second rotating member.

According to an another aspect of the present invention, there is provided a roll medium conveying device including the above back tension mechanism.

DETAILED DESCRIPTION OF THE INVENTION

An embodiment of the present invention will now be described with reference to the drawings.

Figure 1:
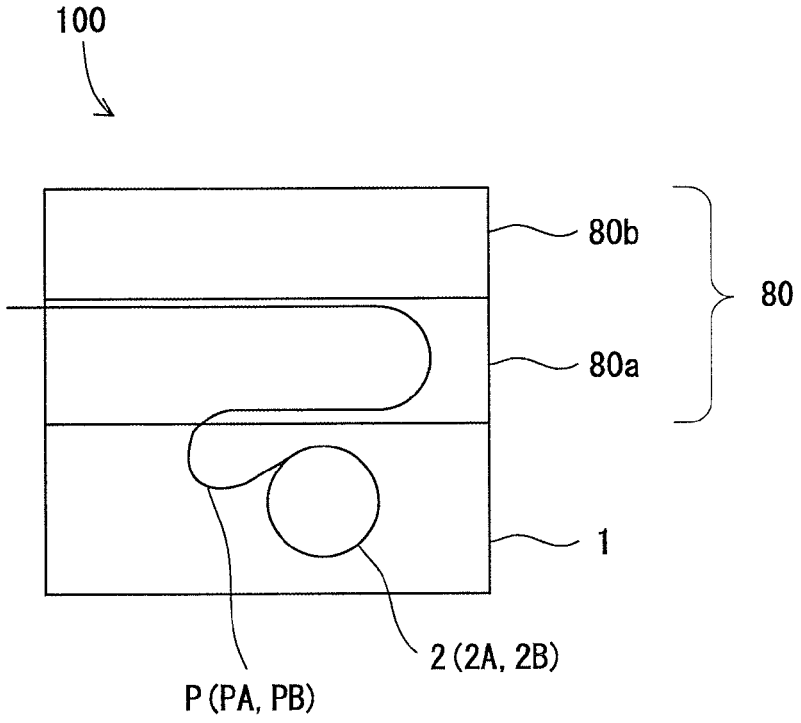
FIG. 1 is a schematic diagram illustrating a configuration of a printing system of an embodiment.

FIG. 1 is a schematic diagram illustrating a configuration of a printing system 100 including a roll paper conveying device 1 as a roll medium conveying device according to an embodiment of the present invention. In FIG. 1, the printing system 100 includes the roll paper conveying device 1 and a printing device (or printer) 80. A paper roll 2 is mounted to the roll paper conveying device 1. The roll paper conveying device 1 rotatably supports the mounted paper roll 2 and conveys paper P drawn from the paper roll 2. The printing device 80 is disposed after the roll paper conveying device 1 and prints on the paper P conveyed by the roll paper conveying device 1. The paper P has, on one side, a printing surface for printing, and the printing device 80 prints on the printing surface of the paper P. In the example of FIG. 1, the printing device 80 is disposed above the roll paper conveying device 1. The printing device 80 includes a medium conveying unit 80*a* for conveying paper P fed from the roll paper conveying device 1, and an image forming unit 80*b* for forming an image on the printing surface of the paper P conveyed by the medium conveying unit 80*a*. The image forming unit 80*b* is disposed above the medium conveying unit 80*a*.

An outward wound paper roll 2A with its printing surface facing outward and an inward wound paper roll 2B with its printing surface facing inward can be used as the paper roll 2. Thus, an outward wound paper roll 2A and an inward wound paper roll 2B can be selectively mounted to the roll paper conveying device 1 as the paper roll 2.

Figure 2:
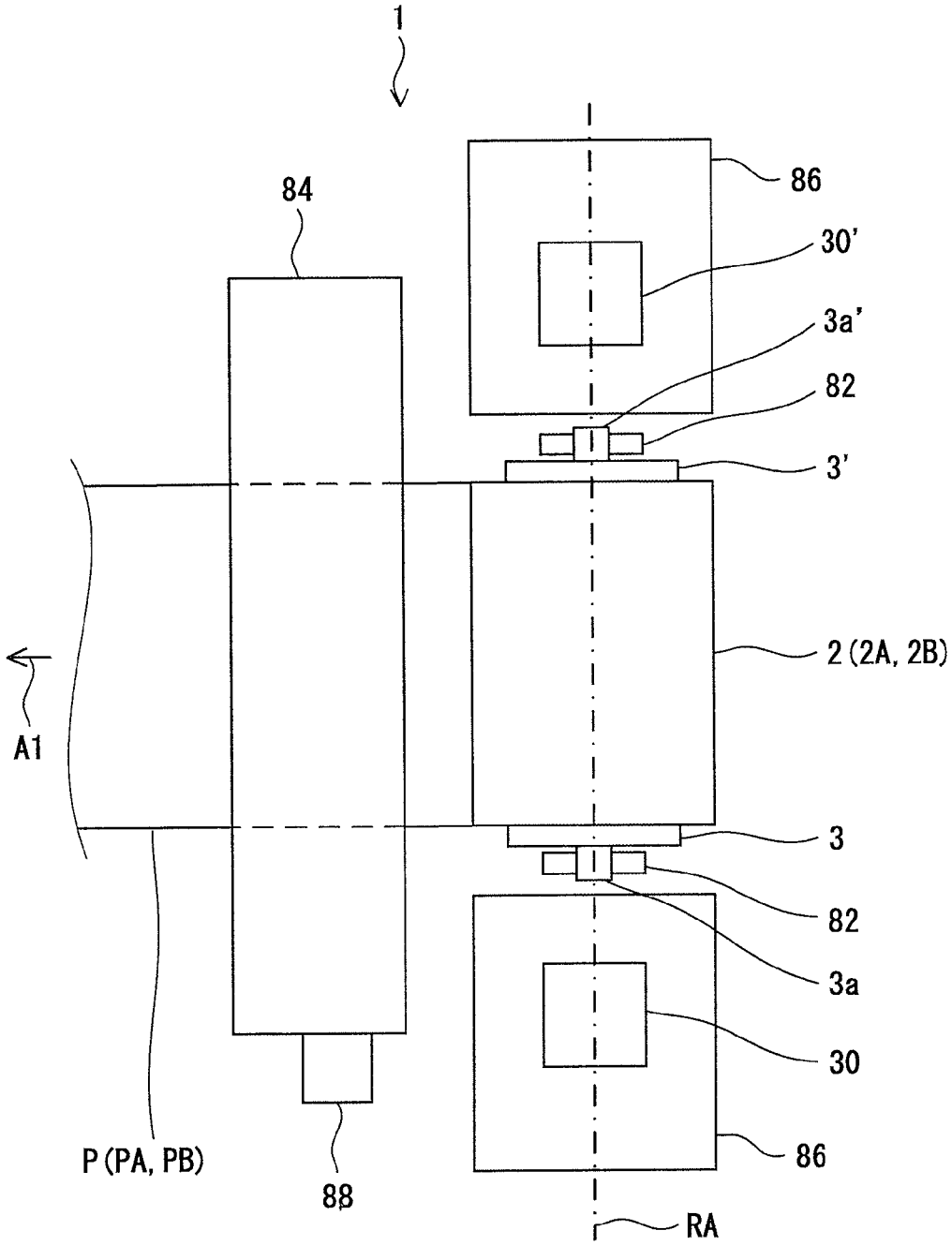
FIG. 2 is a schematic diagram illustrating a functional configuration of a roll paper conveying device of the embodiment.

FIG. 2 is a schematic diagram illustrating a functional configuration of the roll paper conveying device 1.

In FIG. 2, the roll paper conveying device 1 includes a supporting mechanism 82, a conveying unit 84, back tension mechanisms (or units) 30 and 30', and an adjustment mechanism 86.

The supporting mechanism 82 supports the paper roll 2 rotatably about a rotational axis RA. Specifically, the paper roll 2 has a core (or paper tube) around which paper is wound. A flange 3 is mounted to one end of the paper roll 2 (specifically, the core of the paper roll 2), and a flange 3' is mounted to the other end of the paper roll 2 (specifically, the core of the paper roll 2), in a direction (referred to below as the rotational axis direction) parallel to the rotational axis RA. The flanges 3 and 3' respectively have axle portions 3*a* and 3*a'* serving as an axle of the paper roll 2. The axle portions 3*a* and 3*a'* project from both ends of the paper roll 2 in the rotational axis direction. The flange 3 (specifically, the axle portion 3*a*) has a gear-shaped hole (not illustrated) as a shaft hole for engaging the paper roll 2 with the back tension mechanism 30, and the flange 3' (specifically, the axle portion 3*a'*) has a gear-shaped hole (not illustrated) as a shaft hole for engaging the paper roll 2 with the back tension mechanism 30'. The supporting mechanism 82 rotatably supports the axle portions 3*a* and 3*a*' of a pair of the flanges 3 and 3'.

The conveying unit 84 conveys the paper P drawn from the paper roll 2 in a conveying direction indicated by arrow A1 in FIG. 2.

The back tension mechanisms 30 and 30' apply back tension to the paper P or paper roll 2. The back tension mechanism 30 is disposed so as to face one end of the paper roll 2 and the back tension mechanism 30' is disposed so as to face the other end of the paper roll 2. The back tension mechanisms 30 and 30' are configured to be connected to the axle portions 3*a* and 3*a*', respectively.

The adjustment mechanism 86 supports the back tension mechanisms 30 and 30' movably in the rotational axis direction. The adjustment mechanism 86 is used for adjusting the distance between the back tension mechanisms 30 and 30' in the rotational axis direction according to the width of the paper roll 2 in the rotational axis direction.

Figure 3:
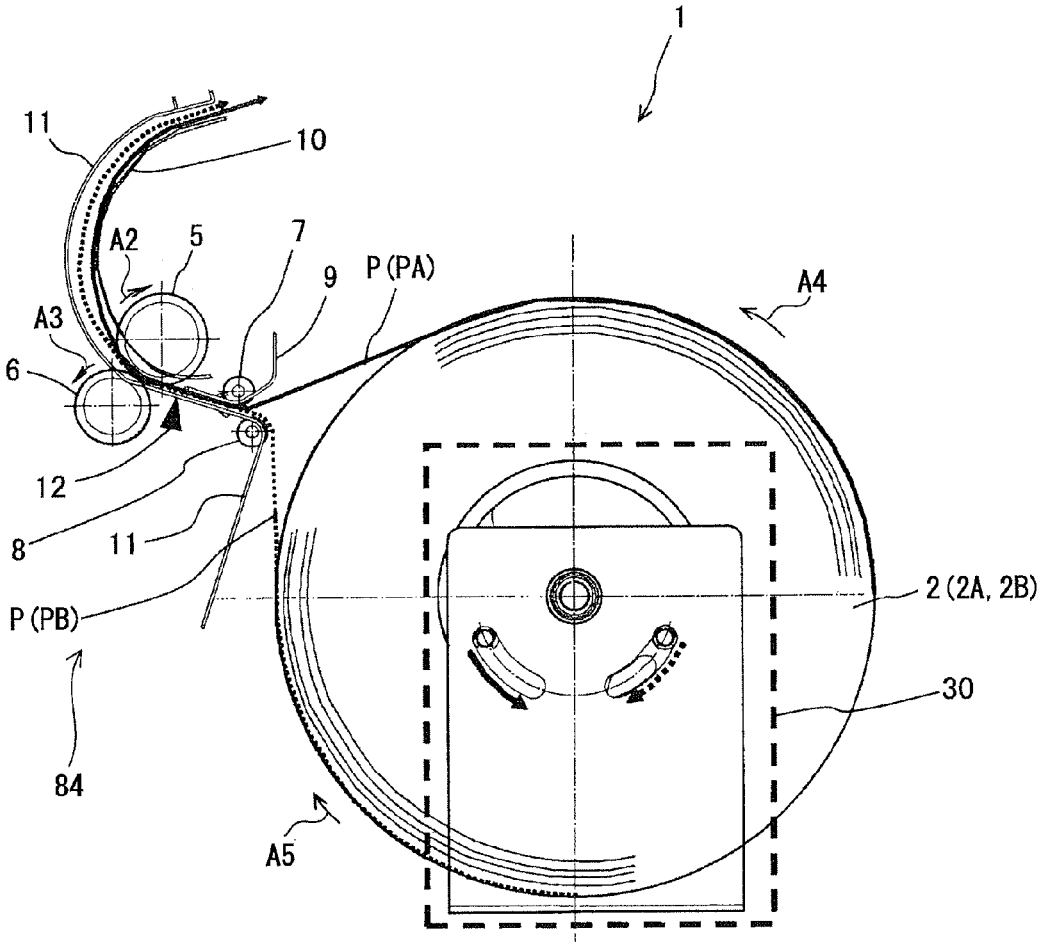
FIG. 3 is a side view illustrating the main components of the roll paper conveying device.
Figure 4:
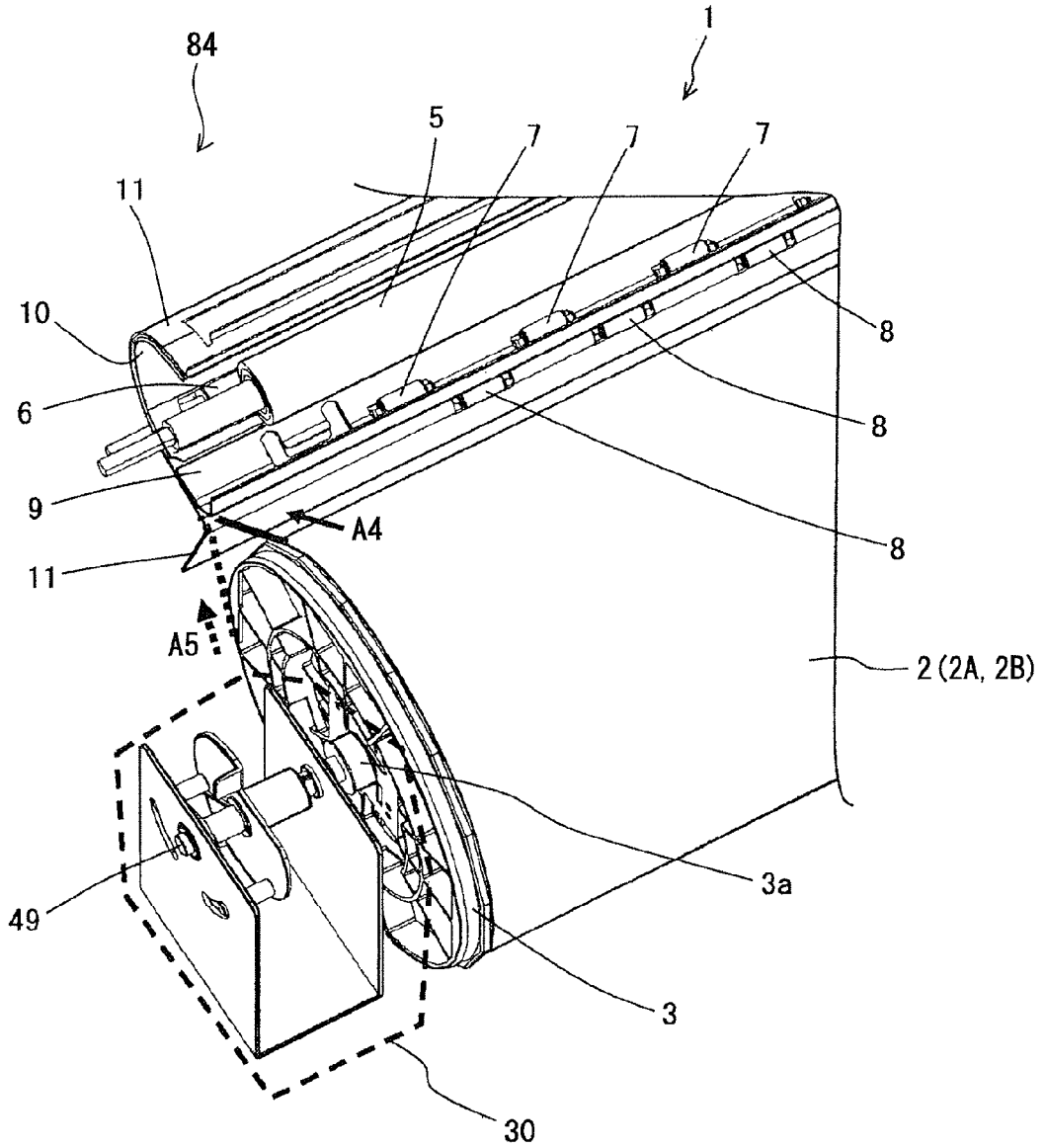
FIG. 4 is a top perspective view of the roll paper conveying device.
Figure 7A:
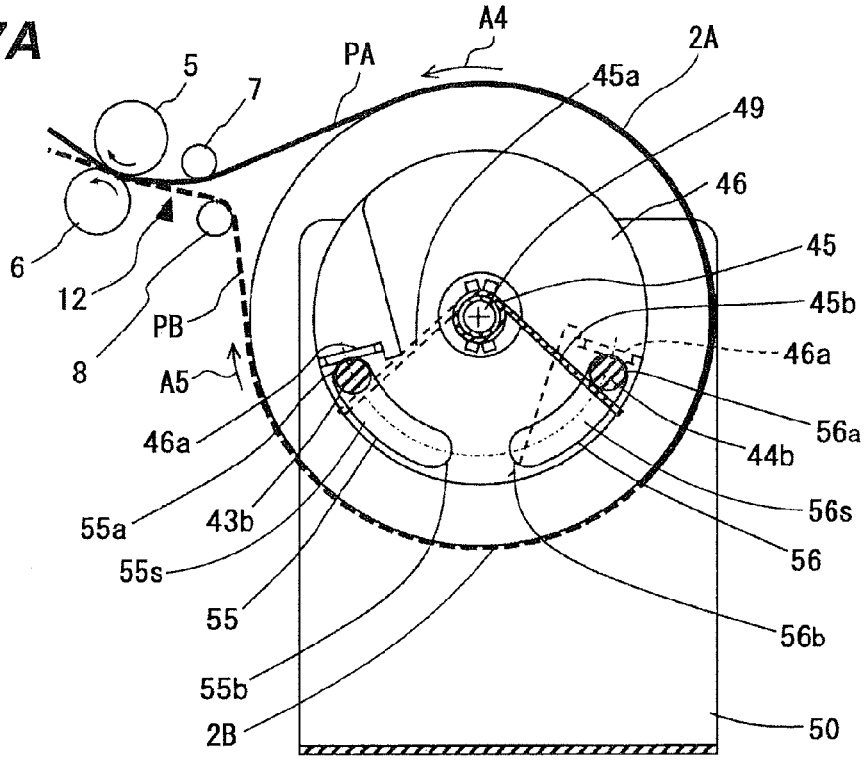
FIGS. 7A, 7B, 8A, 8B, 9A, 9B, 10A, 10B, 11A, 11B, 12A, 12B, 13A, and 13B are diagrams for explaining the operation of the back tension mechanism.

FIG. 3 is a side view illustrating the main components of the roll paper conveying device 1. FIG. 4 is a top perspective view of the roll paper conveying device 1. FIG. 4 illustrates one end of the roll paper conveying device 1 at which the back tension mechanism 30 is disposed. In FIGS. 3, 4, and 7, paper PA of the outward wound paper roll 2A is indicated by a solid line, and paper PB of the inward wound paper roll 2B is indicated by a dashed line.

The conveying unit 84 includes an upper feed roller 5, a lower feed roller 6, an upper idle roller 7, a lower idle roller 8, a first upper sheet guide 9, a second upper sheet guide 10, a lower sheet guide 11, a paper set sensor 12, and the like. The upper feed roller 5 and lower feed roller 6 are upper and lower rollers for conveying the paper P drawn from the paper roll 2. The upper feed roller 5 and lower feed roller 6 form a nip portion therebetween. The upper feed roller 5 and lower feed roller 6 are connected to a knob 88 (FIG. 2) for rotating them. The upper idle roller 7 bends the paper PA from the outward wound paper roll 2A and rotates along with movement of the paper PA. The lower idle roller 8 bends the paper PB from the inward wound paper roll 2B and rotates along with movement of the paper PB. The first upper sheet guide 9, second upper sheet guide 10, and lower sheet guide 11 guide the paper P from the paper roll 2 and form a conveying path of the paper P. The paper set sensor 12 detects the presence or absence of the paper P from the paper roll 2.

The upper feed roller 5 and lower feed roller 6 are driven to rotate in directions indicated by arrows A2 and A3 in FIG. 3 as described later, thereby conveying the paper P in the conveying direction. At this time, if the paper roll 2 is an outward wound paper roll 2A, the paper roll 2 rotates in a direction indicated by arrow A4, and the paper P contacts and rotates the upper idle roller 7, which contacts and guides the paper P; if the paper roll 2 is an inward wound paper roll 2B, the paper roll 2 rotates in a direction indicated by arrow A5, and the paper P contacts and rotates the lower idle roller 8, which contacts and guides the paper P.

Regardless of whether the paper roll 2 is an outward wound paper roll 2A or an inward wound paper roll 2B, the printing surface of the paper P faces the upper feed roller 5 when the paper P passes through the upper feed roller 5 and lower feed roller 6, and the printing device 80, which is disposed after or downstream of the upper feed roller 5 and lower feed roller 6 in the conveying direction, prints on the printing surface.

Next, the configuration and operation of the back tension mechanism 30 will be described. The configuration and operation of the back tension mechanism 30' are substantially the same as those of the back tension mechanism 30. However, the back tension mechanisms 30 and 30' are symmetric with respect to a virtual plane that passes through the center of the paper roll 2 in a longitudinal direction of the paper roll 2 parallel to the rotational axis direction and is perpendicular to the longitudinal direction. The flanges 3 and 3' are also symmetric with respect to the virtual plane.

Figure 5:
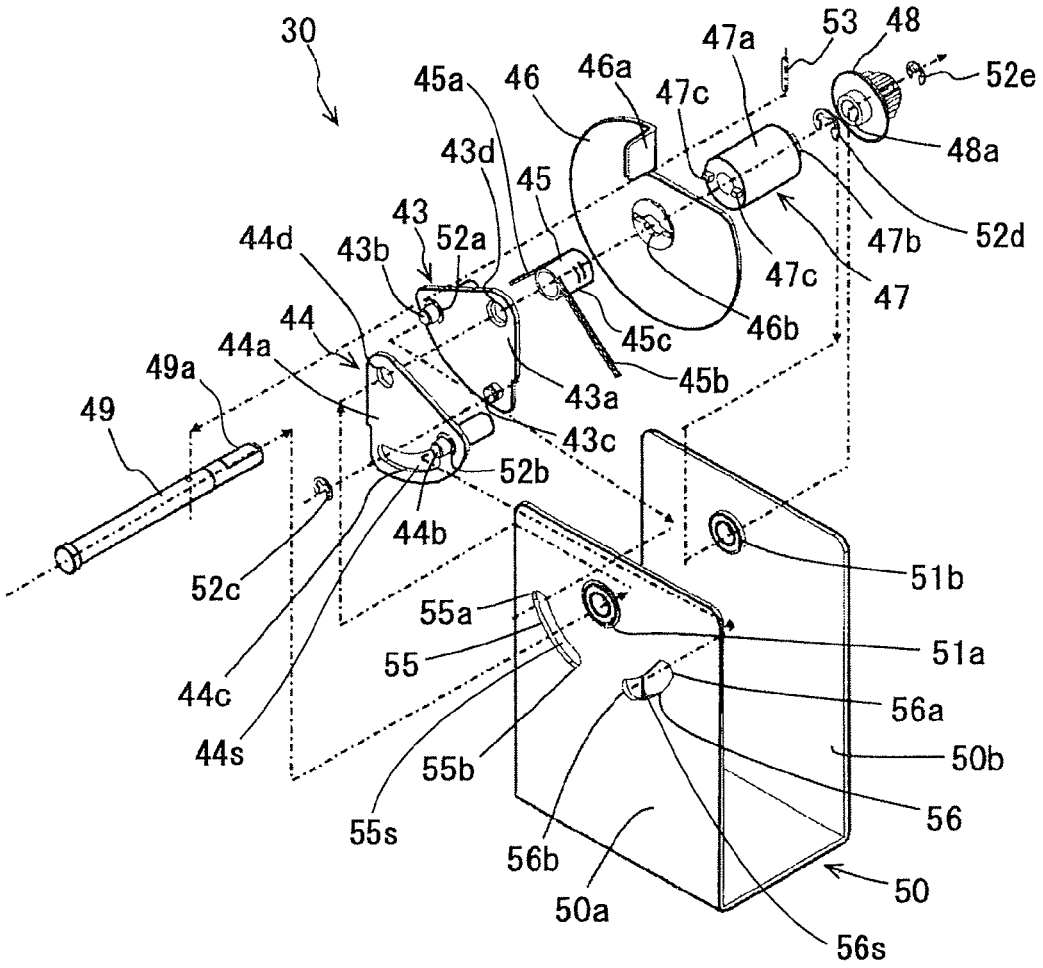
FIG. 5 is an exploded perspective view of a back tension mechanism.
Figure 6:
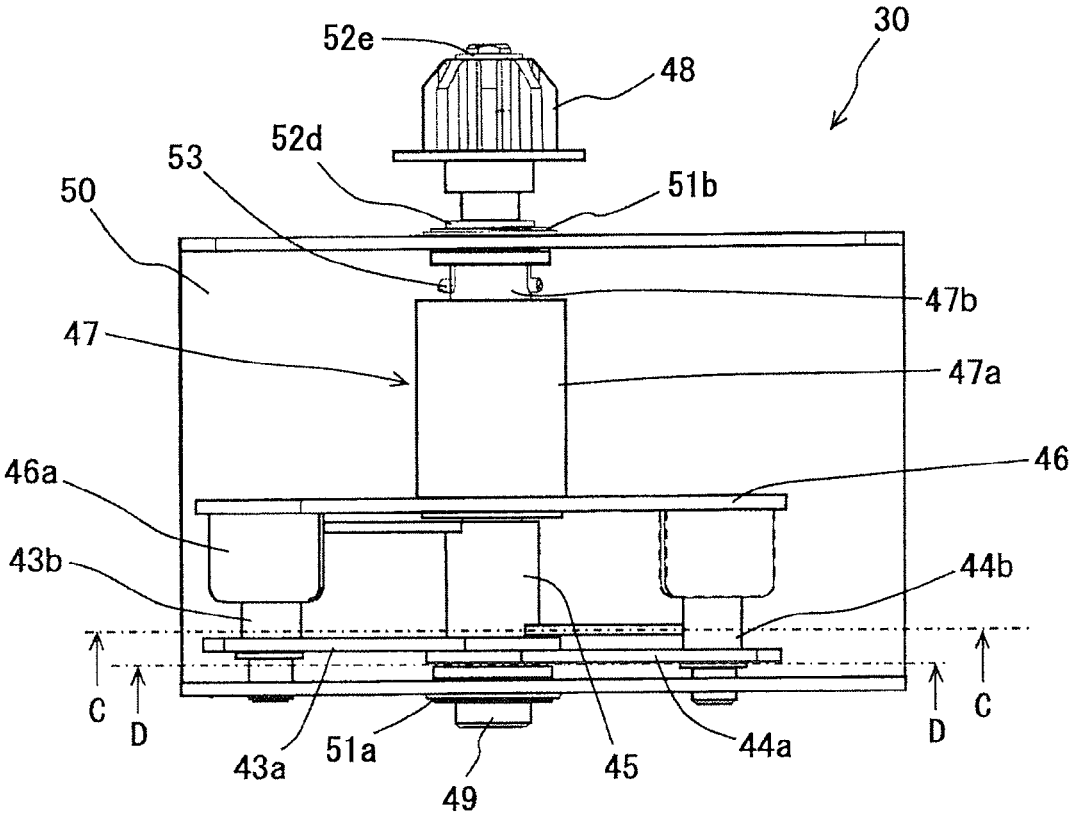
FIG. 6 is a plan view of the back tension mechanism after assembly and before operation.

FIG. 5 is an exploded perspective view of the back tension mechanism 30. FIG. 6 is a plan view of the back tension mechanism 30 after assembly and before operation described later.

As illustrated in FIGS. 5 and 6, the back tension mechanism 30 includes a first bracket assembly 43, a second bracket assembly 44, a torsion spring 45, a tension plate 46, a torque limiter 47, a shaft 49, a retainer gear 48, a guide 50, E-rings 52*a* to 52*e*, and a spring pin 53.

The shaft 49 is configured to be connected to the axle of the paper roll 2 and rotate in synchronization with rotation of the paper roll 2. Specifically, the shaft 49 is configured to rotate integrally with the flange 3 with an end of the shaft 49 (in this embodiment, the retainer gear 48 mounted on the end of the shaft 49) fitted in the shaft hole of the flange 3. The shaft 49 rotatably supports various members as described later. The shaft 49 is disposed coaxially with the axle portion 3*a* of the flange 3.

The tension plate 46 serves as a rotation transmitting member (or plate) for rotating the first bracket assembly 43 or second bracket assembly 44. The tension plate 46 is connected to the shaft 49 via the torque limiter 47 and configured to rotate coaxially with the shaft 49. The tension plate 46 has a bent portion 46*a* as an engaging portion for transmitting rotation of the tension plate 46.

The first bracket assembly 43 serves as a first rotating member (or plate) relating to generation of back tension when an outward wound paper roll 2A is used. The first bracket assembly 43 is rotatably supported by the shaft 49. The first bracket assembly 43 has a first post 43*b* as a first engaged portion configured to, when the tension plate 46 rotates in a first rotational direction (the direction of arrow A4 in FIG. 3), engage with the bent portion 46*a* to receive a rotational force of the rotation of the tension plate 46. The first post 43*b* is formed by a post-shaped member.

The second bracket assembly 44 serves as a second rotating member (or plate) relating to generation of back tension when an inward wound paper roll 2B is used. The second bracket assembly 44 is rotatably supported by the shaft 49. The second bracket assembly 44 has a second post 44*b* as a second engaged portion configured to, when the tension plate 46 rotates in a second rotational direction (the direction of arrow A5 in FIG. 3) opposite to the first rotational direction, engage with the bent portion 46*a* to receive a rotational force of the rotation of the tension plate 46. The second post 44*b* is formed by a post-shaped member.

The torsion spring 45 serves as an urging member for applying back tension to the paper P or paper roll 2 at the time of stop of conveyance of the paper P. The torsion spring 45 urges the first bracket assembly 43 in the second rotational direction and urges the second bracket assembly 44 in the first rotational direction. The torsion spring 45 is supported by the shaft 49. The torsion spring 45 has an arm portion 45*a* as a first end urging the first post 43*b* and an arm portion 45*b* as a second end urging the second post 44*b*.

The torque limiter 47 generates a load torque to apply back tension to the paper P or paper roll 2 during conveyance of the paper P. The torque limiter 47 is configured to, when the shaft 49 rotates relative to the tension plate 46, apply a load torque to the shaft 49 in an direction opposite to the rotational direction of the shaft 49. Specifically, the torque limiter 47 includes a first member and a second member, and is configured to, when the second member rotates relative to the first member, apply a load torque to the second member in a direction opposite to the rotational direction of the second member. The first member is connected to the tension plate 46, and the second member is connected to the shaft 49. In this embodiment, the torque limiter 47 includes a housing 47*a* (or outer member) as the first member and an inner ring 47*b* (or inner member) as the second member.

The retainer gear 48 transmits rotation of the paper roll 2 to the shaft 49.

The guide 50 serves as a base for rotatably supporting the shaft 49. The guide 50 supports the shaft 49 via bearings 51*a* and 51*b*. The guide 50 has a slot wall 55 as a first limiting portion for limiting a range of rotation of the first bracket assembly 43 and a slot wall 56 as a second limiting portion for limiting a range of rotation of the second bracket assembly 44. The slot wall 55 defines an arc-shaped slot 55*s* in which the first post 43*b* is fitted. The slot wall 56 defines an arc-shaped slot 56*s* in which the second post 44*b* is fitted. The guide 50 is supported movably in a direction parallel to the shaft 49.

In one aspect, a force with which the torsion spring 45 urges the first bracket assembly 43 and a force with which the torsion spring 45 urges the second bracket assembly 44 are smaller than a force resulting from the load torque generated by the torque limiter 47.

The first bracket assembly 43 includes a first bracket 43*a*, a guide post 43*c* formed integrally with the first bracket 43*a*, and the first post 43*b* that passes through the first bracket 43*a* and is fastened to the first bracket 43*a* by the E-ring 52*a*. The second bracket assembly 44 includes a second bracket 44*a* and the second post 44*b* that passes through the second bracket 44*a* and is fastened to the second bracket 44*a* by the E-ring 52*b*. The second post 44*b* is identical to the first post 43*b*.

The second bracket assembly 44 (specifically, the second bracket 44*a*) has a slot wall 44*c* defining an arc-shaped slot 44*s*. The guide post 43*c* of the first bracket assembly 43 passes through the arc-shaped slot 44*s* in the second bracket assembly 44 and is fastened by the E-ring 52*c*, so that the first bracket assembly 43 and second bracket assembly 44 are connected to each other to form an assembly.

The guide 50 has a pair of side walls 50*a* and 50*b* facing each other. The bearings 51*a* and 51*b* are respectively disposed in the side walls 50*a* and 50*b* so as to face each other. The guide 50 rotatably supports the shaft 49 with the shaft 49 fitted in the bearings 51*a* and 51*b*. The side wall 50*a* has the slots 55*s* and 56*s* formed in arc shapes about an axis of rotation of the bearing 51*a*. The side wall 50*a* has the slot wall 55 defining the slot 55*s* and the slot wall 56 defining the slot 56*s*. The slot wall 55 extends from an upper end portion 55*a* to a lower end portion 55*b*. The slot wall 56 extends from an upper end portion 56*a* to a lower end portion 56*b*.

As illustrated in FIG. 5, the first bracket 43*a* has a shaft hole 43*d*. The second bracket 44*a* has a shaft hole 44*d*. The tension plate 46 has a shaft hole 46*b*. The shaft 49 has a front end portion 49*a* having a D-shaped cross section. The retainer gear 48 has a center hole 48*a*. The shaft 49 passes through the bearing 51*a*, the shaft hole 44*d* of the second bracket 44*a*, the shaft hole 43*d* of the first bracket 43*a*, the torsion spring 45, the shaft hole 46*b* of the tension plate 46, the torque limiter 47, the bearing 51*b*, and the center hole 48*a* of the retainer gear 48 in this order so that the retainer gear 48 is located on the front end portion 49*a*. The E-ring 52*d* is attached to the shaft 49 between the bearing 51*b* and the retainer gear 48 to restrict movement of the shaft 49 in its axial direction. The E-ring 52*e* is attached to the shaft 49 outside the retainer gear 48 to prevent the retainer gear 48 from falling off the shaft 49.

The shaft 49 loosely passes through and rotatably supports the first bracket 43*a*, second bracket 44*a*, torsion spring 45, and tension plate 46. The shaft 49 is configured to rotate integrally with the inner ring 47*b* of the torque limiter 47. Specifically, the spring pin 53 connects the shaft 49 to the inner ring 47*b* and prevents slippage between the shaft 49 and the inner ring 47*b*. The torque limiter 47 is configured to, when the shaft 49 rotates relative to the housing 47*a*, generate a predetermined or constant load torque in a direction opposite to the direction of rotation of the shaft 49.

The housing 47*a* has a pair of projections 47*c* projecting toward the tension plate 46. The tension plate 46 has engagement holes formed corresponding to the projections 47*c*. The projections 47*c* are fitted in the engagement holes so that the housing 47*a* rotates integrally with the tension plate 46 relative to the shaft 49. Thus, when the shaft 49 rotates relative to the tension plate 46, the torque limiter 47 generates the predetermined load torque in a direction opposite to the direction of rotation of the shaft 49.

The slots 55*s* and 56*s* formed in the side wall 50*a* of the guide 50 and the arc-shaped slot 44*s* in the second bracket assembly 44 are formed on the same arc as viewed in a direction of a rotational axis of the shaft 49.

In the assembled back tension mechanism 30, an end portion on the side wall 50*a* side of the first post 43*b* is fitted in the slot 55*s* of the side wall 50*a*, and an end portion on the side wall 50*a* side of the second post 44*b* is fitted in the slot 56*s* of the side wall 50*a*.

The torsion spring 45 has the two arm portions 45*a* and 45*b* and a coil portion 45*c*. The shaft 49 passes through the coil portion 45*c*. The arm portions 45*a* and 45*b* are respectively disposed below the first post 43*b* of the first bracket assembly 43 and the second post 44*b* of the second bracket assembly 44, which are adjacent to the arm portions 45*a* and 45*b*, so as to urge the first post 43*b* and second post 44*b* upward (see FIG. 7A).

Thus, the first bracket assembly 43 and second bracket assembly 44 are urged in opposite rotational directions (directions in which the first post 43*b* and second post 44*b* are separated from each other) about the shaft 49. The first post 43*b* of the first bracket assembly 43 is in contact with and pressed against the upper end portion 55*a* of the slot wall 55 of the side wall 50*a* (see FIG. 7A). The second post 44*b* of the second bracket assembly 44 is in contact with and pressed against the upper end portion 56*a* of the slot wall 56 of the side wall 50*a* (see FIG. 7A).

From this state, when the tension plate 46 rotates, the bent portion 46*a* of the tension plate 46 abuts one of the first post 43*b* of the first bracket assembly 43 and the second post 44*b* of the second bracket assembly 44 from above, depending on the direction of rotation of the tension plate 46.

The guide 50 is supported by the adjustment mechanism 86 slidably in the rotational axis direction of the paper roll 2, which coincides with the axial direction of the shaft 49, so that the back tension mechanism 30 is supported connectably to and separably from the paper roll 2.

Mounting of a paper roll 2 to the roll paper conveying device 1 will be described. The paper roll 2 may be mounted to the roll paper conveying device 1 by a user.

First, the pair of flanges 3 and 3' are attached to both ends of the paper tube of the paper roll 2, and then the paper roll 2 with the pair of flanges 3 and 3' is placed in the roll paper conveying device 1. At this time, the back tension mechanisms 30 and 30' are away from the paper roll 2, and the axle portions 3*a* and 3*a'* of the pair of flanges 3 and 3' are rotatably supported by the supporting mechanism 82 of the roll paper conveying device 1. At this time, the axle portions 3*a* and 3*a*' of the pair of flanges 3 and 3' of the placed paper roll 2 are arranged coaxially with the shafts 49 of the back tension mechanisms 30 and 30'.

Then, the back tension mechanisms 30 and 30' are moved toward the flanges 3 and 3' attached to the paper roll 2, and the retainer gears 48 fixed to the front end portions 49*a* of the shafts 49 of the back tension mechanisms 30 and 30' are fitted into the gear-shaped holes (not illustrated) formed in the axle portions 3*a* and 3*a*' of the flanges 3 and 3', so that the shafts 49 are connected to the axle of the paper roll 2 and the shafts 49 can rotate integrally with the paper roll 2.

After that, the paper P is drawn from the paper roll 2 to the conveying path, and the leading edge of the paper P is caused to abut against the upper feed roller 5 and lower feed roller 6 at the nip portion. The upper feed roller 5 and lower feed roller 6 are rotated in the directions of arrows A2 and A3 in FIG. 3 by rotating the knob 88. This moves the leading edge of the paper P downstream of the nip portion, and stretches the paper P, which is nipped between the upper feed roller 5 and the lower feed roller 6, without slack upstream of the nip portion. This state will be referred to below as the initial set state.

FIG. 6 illustrates the back tension mechanism 30 in the initial set state as viewed from above. FIGS. 7A, 7B, 8A, 8B, 9A, 9B, 10A, 10B, 11A, 11B, 12A, 12B, 13A, and 13B are diagrams for explaining the operation of the back tension mechanism 30. FIGS. 7A, 8A, 9A, 10A, 11A, 12A, and 13A correspond to sectional views along line C-C of FIG. 6. FIGS. 7B, 8B, 9B, 10B, 11B, 12B, and 13B correspond to sectional views along line D-D of FIG. 6.

Hereinafter, the operation of the roll paper conveying device 1 after mounting of the paper roll 2 will be described.

First, the operation of the roll paper conveying device 1 with an outward wound paper roll 2A (referred to below simply as the paper roll 2A) mounted thereto as the paper roll 2 will be described with reference to FIGS. 6, 7A, 7B, 8A, 8B, 9A, 9B, 10A, and 10B.

For example, when the printing device 80 starts to operate, the upper feed roller 5 and lower feed roller 6 are rotationally driven in synchronization with the start of the operation and start to rotate in the directions of arrows A2 and A3 in FIG. 3 to convey the nipped paper PA downstream. Thereby, the paper roll 2A, which is indicated by solid lines, starts to rotate in the direction of arrow A4. The upper feed roller 5 and lower feed roller 6 may be driven and controlled by the printing device 80.

When the paper roll 2A rotates in the direction of arrow A4 (counterclockwise), the tension plate 46 receives a force in the direction of arrow A4 from the paper roll 2A via the torque limiter 47 (FIG. 6) and rotates. Thereby, the bent portion 46*a* abuts the first post 43*b* of the first bracket assembly 43, as indicated by a solid line in FIG. 7A. Further, the tension plate 46 rotates against the urging force of the torsion spring 45 until the first post 43*b* abuts the lower end portion 55*b* of the slot wall 55, as illustrated in FIG. 8A.

Thus, the urging force of the torsion spring 45 is set to be smaller than the force resulting from the load torque generated by the torque limiter 47. While the first post 43*b* moves from the upper end portion 55*a* to the lower end portion 55*b* in the slot 55*s*, the back tension resulting from the urging force of the torsion spring 45 is applied to the paper PA.

Figure 7B:
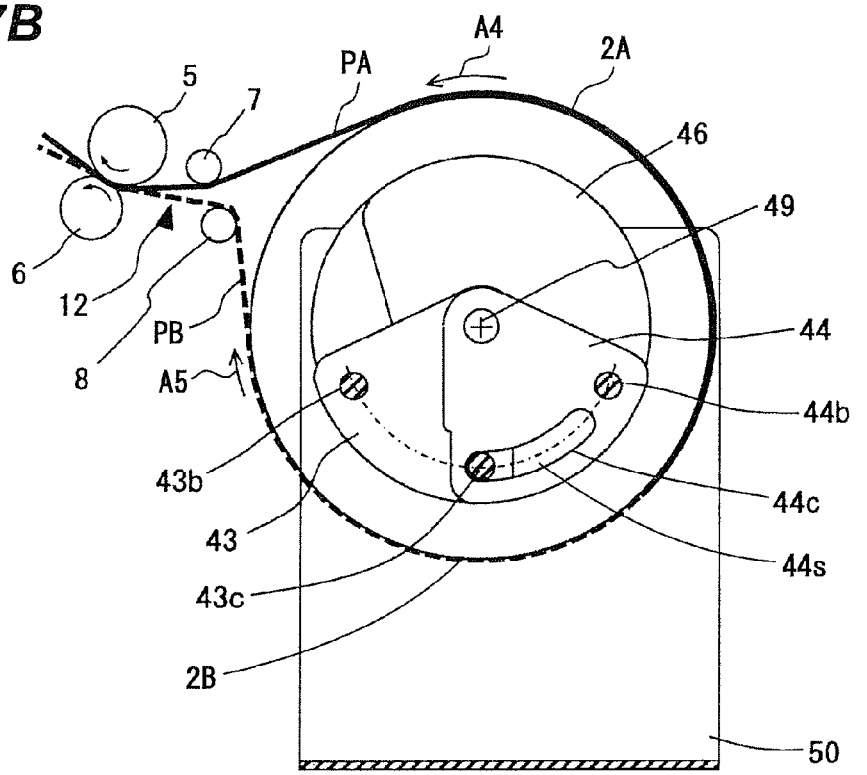
Figure 8A:
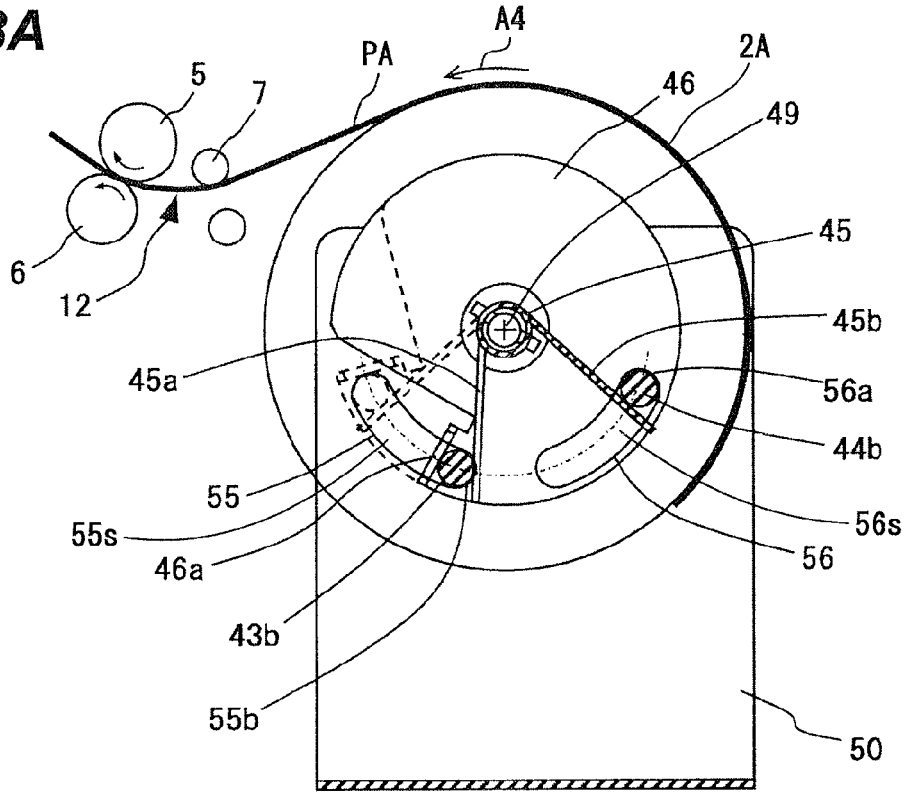
Figure 8B:
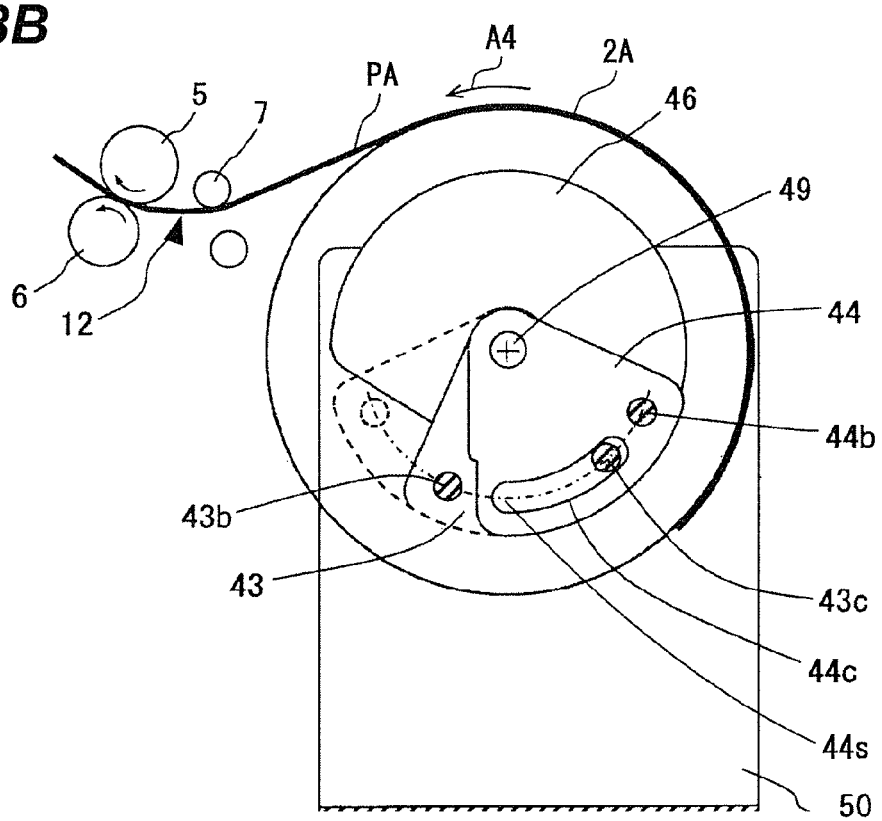

At this time, the first bracket assembly 43 rotates while the guide post 43*c* is guided by the slot wall 44*c* along the slot 44*s* of the second bracket assembly 44, as illustrated in FIGS. 7B and 8B, but the second bracket assembly 44 stays at the position in the initial set state without rotating.

As illustrated in FIGS. 8A and 8B, when the first post 43*b* abuts the lower end portion 55*b* of the slot wall 55, rotation of the tension plate 46 stops. In this state, when the paper PA continues to be conveyed by the upper feed roller 5 and lower feed roller 6, the torque limiter 47 operates and the shaft 49 continues to rotate without rotation of the tension plate 46. At this time, the back tension resulting from the load torque generated by the torque limiter 47 is applied to the paper PA.

The back tension resulting from the load torque generated by the torque limiter 47 continues to be applied to the paper PA until conveyance of the paper PA stops.

Figure 9A:
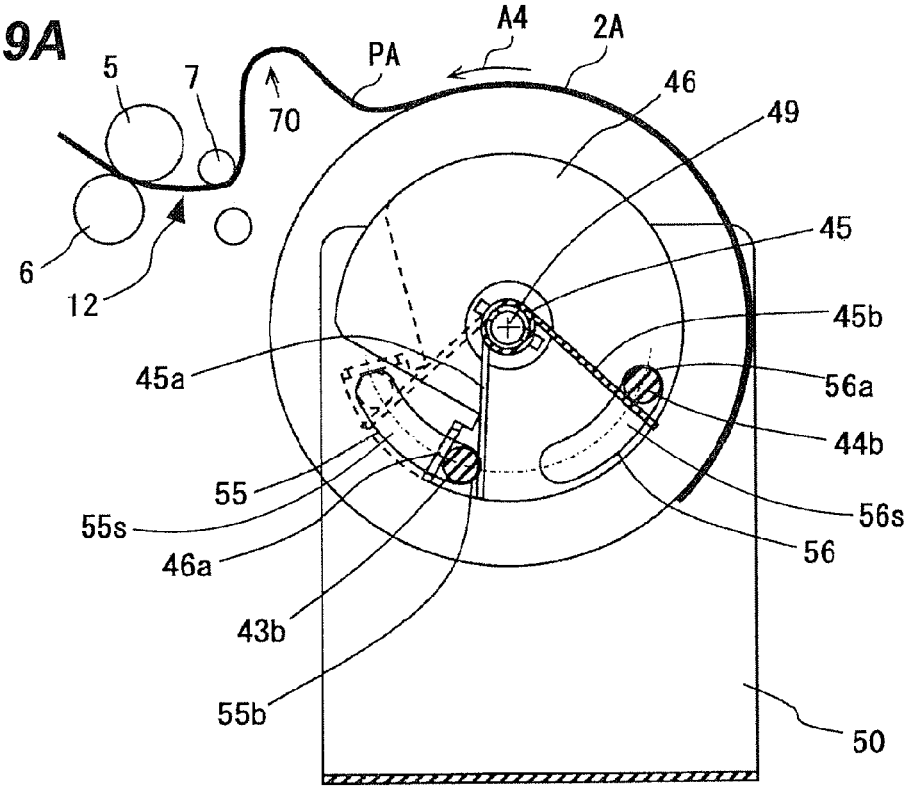
Figure 9B:
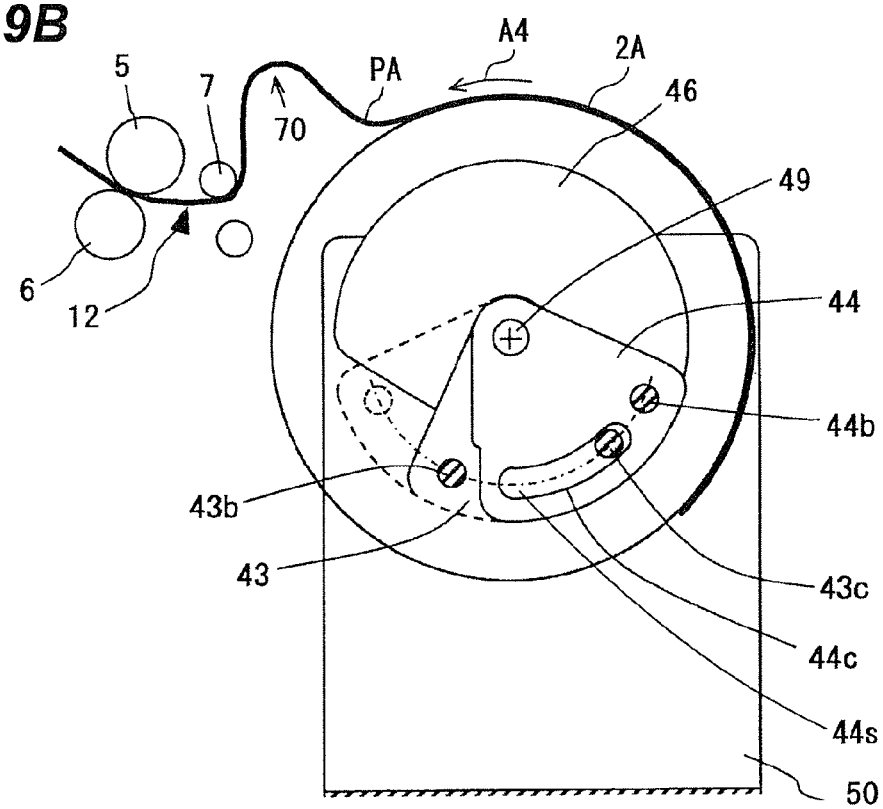

In the above described state illustrated in FIGS. 8A and 8B, when conveyance of the paper PA by the upper feed roller 5 and lower feed roller 6 stops, rotation of the paper roll 2A in the direction of arrow A4 promptly stops due to the load torque of the torque limiter 47. However, due to inertia, it takes a little time before the rotation of the paper roll 2A stops. This causes a slack portion 70 in the paper PA, as illustrated in FIGS. 9A and 9B.

Figure 10A:
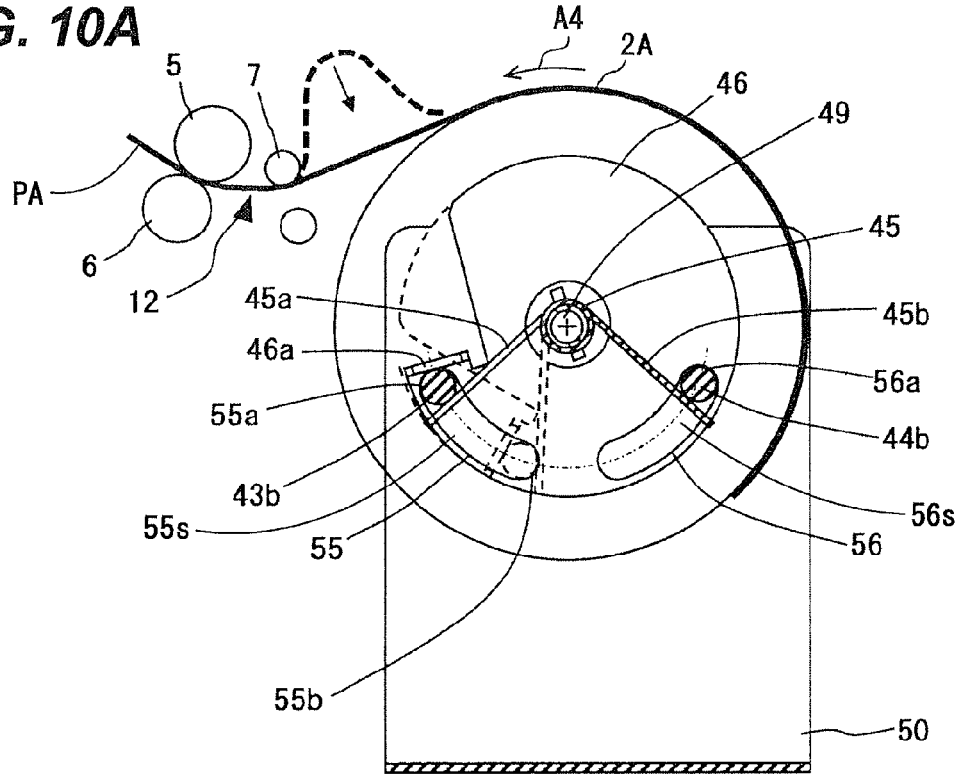
Figure 10B:
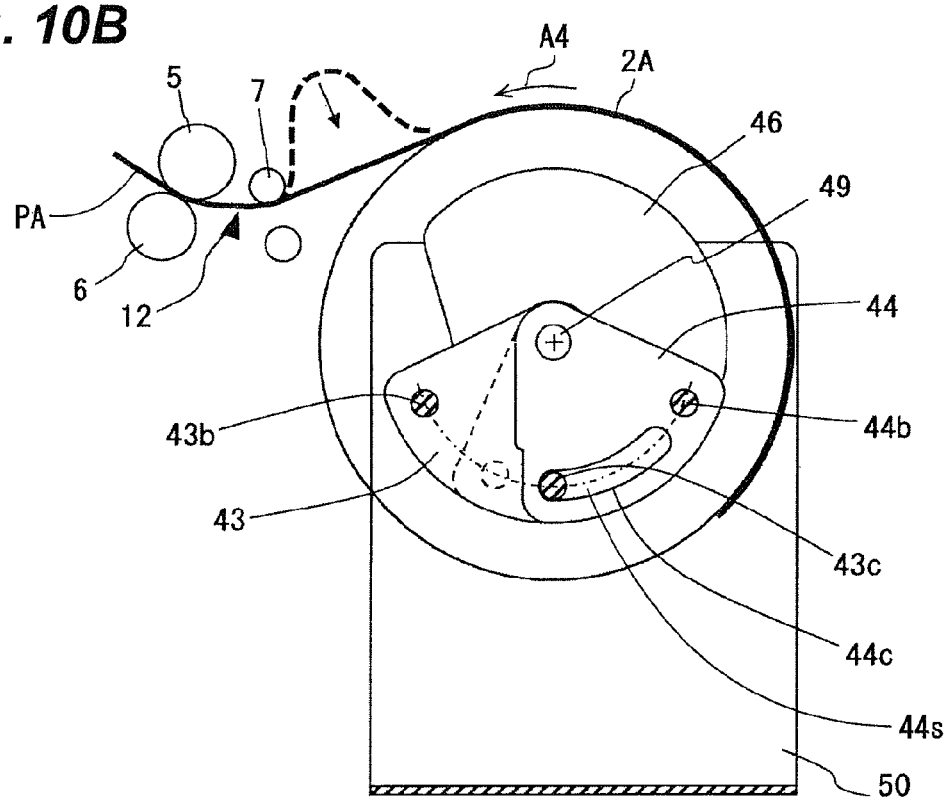

Meanwhile, the first post 43*b* is pressed against the lower end portion 55*b* of the slot wall 55 against the urging force of the torsion spring 45, because of the rotation of the tension plate 46 in the direction of arrow A4 (the shift from the state of FIG. 7A to the state of FIG. 8A) immediately after the start of conveyance. Due to the occurrence of the slack portion 70, the first post 43*b* is released from the pressure of the bent portion 46*a* of the tension plate 46, and pushes back the bent portion 46*a* of the tension plate 46 with the urging force of the torsion spring 45. This reversely rotates the tension plate 46, torque limiter 47, shaft 49, and paper roll 2A in the direction opposite to the direction of arrow A4, thereby reducing or eliminating the slack of the slack portion 70 (FIGS. 9A and 9B) occurring in the paper PA, as illustrated in FIGS. 10A and 10B.

The reverse rotation of the paper roll 2A stops when the first post 43*b* abuts the upper end portion 55*a* of the slot wall 55. Thus, if the slack is eliminated before the first post 43*b* abuts the upper end portion 55*a* of the slot wall 55, the back tension resulting from the urging force of the torsion spring 45 is applied to the paper PA; if the slack is not eliminated, the amount of slack is reduced but some slack remains in the paper PA.

Thus, in one aspect, the roll paper conveying device 1 is configured so that the amount of movement of the outer circumference of the paper roll 2A due to the reverse rotation of the paper roll 2A during movement of the first post 43*b* from the lower end portion 55*b* to the upper end portion 55*a* of the slot wall 55 is greater than the amount of slack occurring when the conveyance is stopped. FIGS. 10A and 10B illustrate a case where the slack is eliminated immediately before the first post 43*b* abuts the upper end portion 55*a* of the slot wall 55.

Next, the operation of the roll paper conveying device 1 with an inward wound paper roll 2B (referred to below simply as the paper roll 2B) mounted thereto as the paper roll 2 will be described with reference to FIGS. 6, 7A, 7B, 11A, 11B, 12A, 12B, 13A, and 13B.

For example, when the printing device 80 starts to operate, the upper feed roller 5 and lower feed roller 6 are rotationally driven in synchronization with the start of the operation and start to rotate in the directions of arrows A2 and A3 in FIG. 3 to convey the nipped paper PB downstream. Thereby, the paper roll 2B, which is indicated by dashed lines, starts to rotate in the direction of arrow A5. The upper feed roller 5 and lower feed roller 6 may be driven and controlled by the printing device 80.

When the paper roll 2B rotates in the direction of arrow A5 (clockwise), the tension plate 46 receives a force in the direction of arrow A5 from the paper roll 2B via the torque limiter 47 (FIG. 6) and rotates. Thereby, the bent portion 46*a* abuts the second post 44*b* of the second bracket assembly 44, as indicated by a dashed line in FIG. 7A. Further, the tension plate 46 rotates against the urging force of the torsion spring 45 until the second post 44*b* abuts the lower end portion 56*b* of the slot wall 56, as illustrated in FIG. 11A.

Thus, the urging force of the torsion spring 45 is set to be smaller than the force resulting from the load torque generated by the torque limiter 47. While the second post 44*b* moves from the upper end portion 56*a* to the lower end portion 56*b* in the slot 56*s*, the back tension resulting from the urging force of the torsion spring 45 is applied to the paper PB.

Figure 11A:
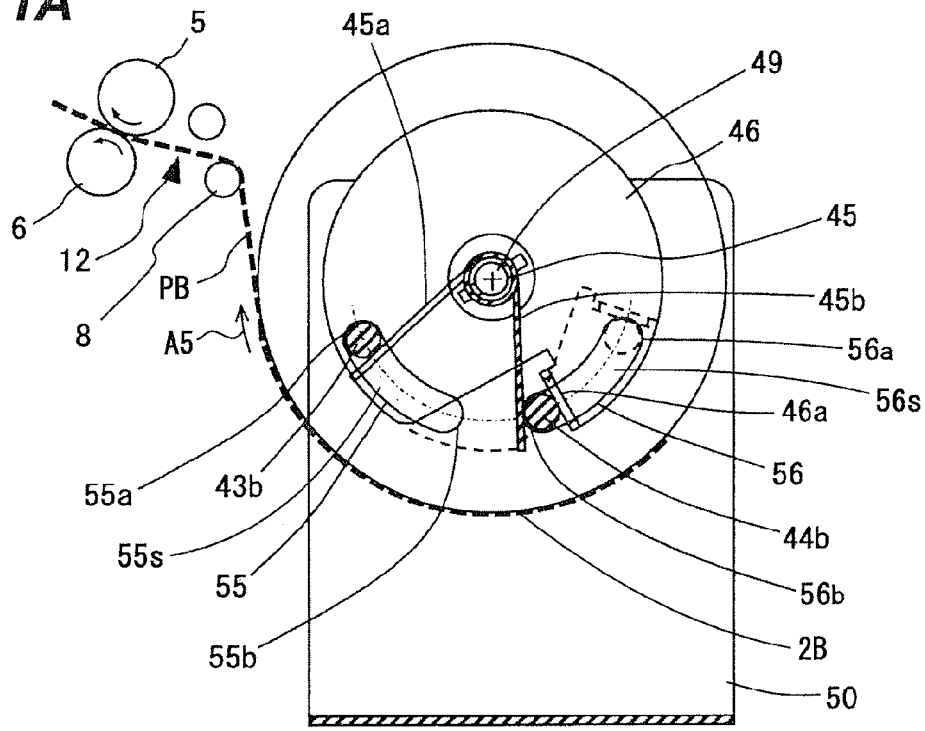
Figure 11B:
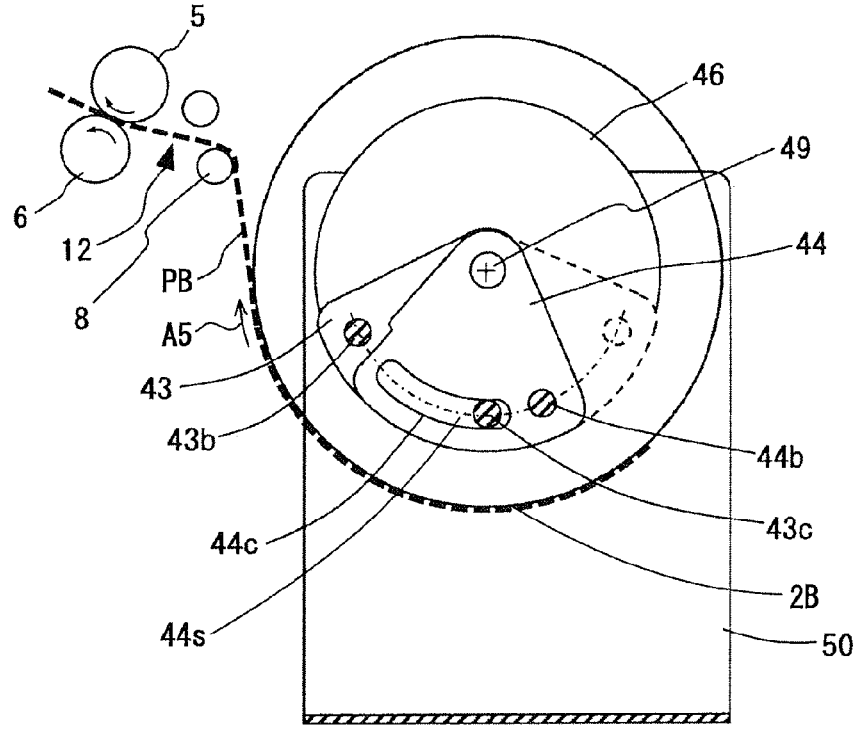

At this time, the second bracket assembly 44 rotates while the slot 44*s* accommodates the guide post 43*c* of the first bracket assembly 43, as illustrated in FIGS. 7B and 11B, but the first bracket assembly 43 stays at the position in the initial set state without rotating.

As illustrated in FIGS. 11A and 11B, when the second post 44*b* abuts the lower end portion 56*b* of the slot wall 56, rotation of the tension plate 46 stops. In this state, when the paper PB continues to be conveyed by the upper feed roller 5 and lower feed roller 6, the torque limiter 47 operates and the shaft 49 continues to rotate without rotation of the tension plate 46. At this time, the back tension resulting from the load torque generated by the torque limiter 47 is applied to the paper. PB.

The back tension resulting from the load torque generated by the torque limiter 47 continues to be applied to the paper PB until conveyance of the paper PB stops.

Figure 12A:
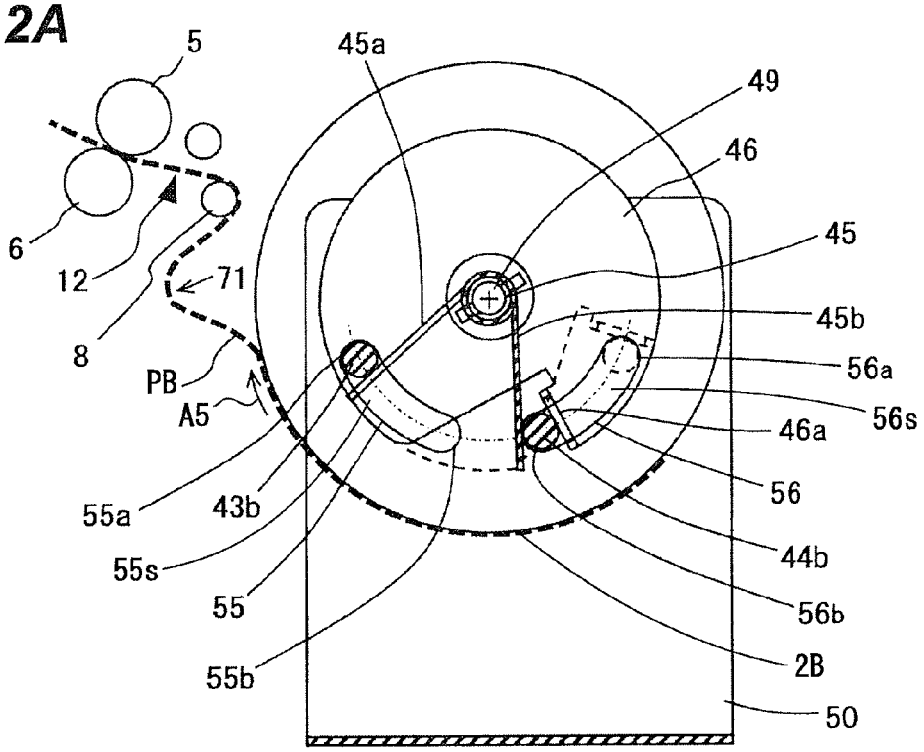
Figure 12B:
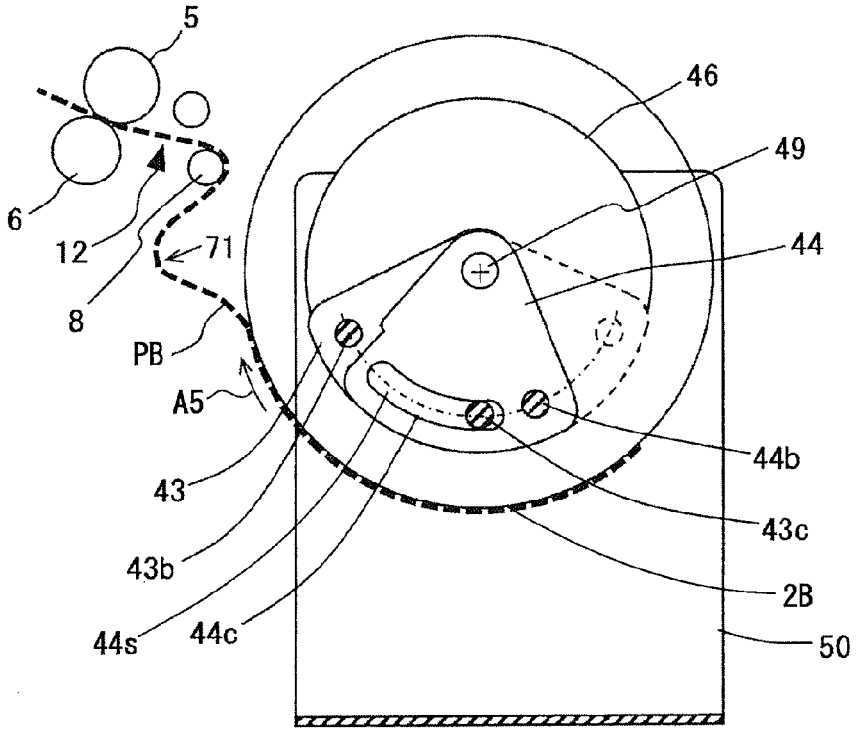

In the above described state illustrated in FIGS. 11A and 11B, when conveyance of the paper PB by the upper feed roller 5 and lower feed roller 6 stops, rotation of the paper roll 2B in the direction of arrow A5 promptly stops due to the load torque of the torque limiter 47. However, due to inertia, it takes a little time before the rotation of the paper roll 2B stops. This causes a slack portion 71 in the paper PB, as illustrated in FIGS. 12A and 12B.

Figure 13A:
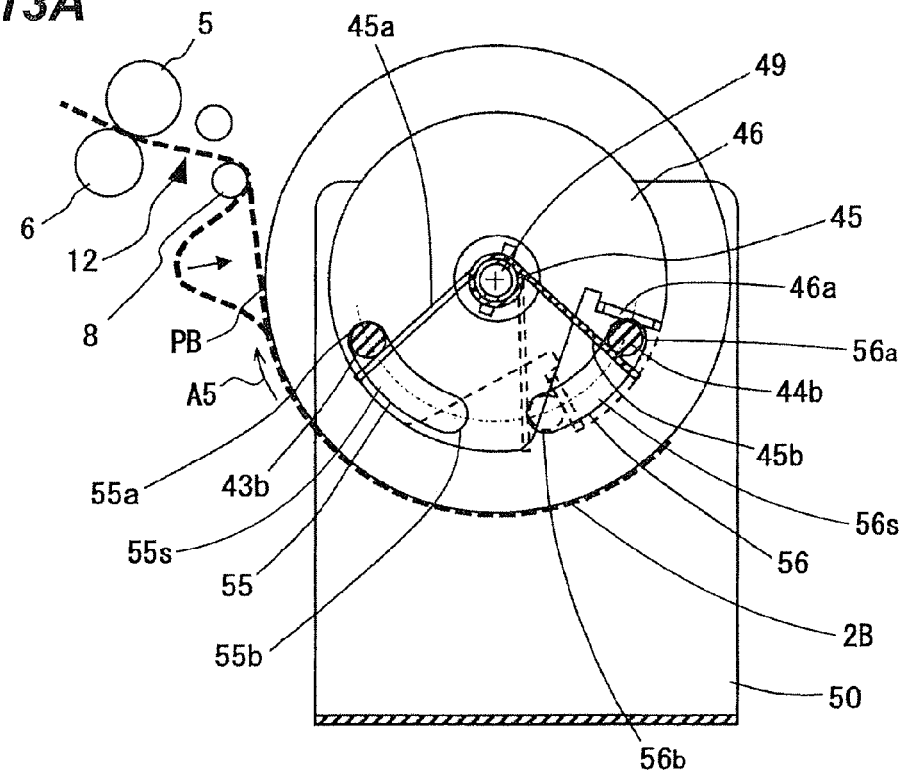
Figure 13B:
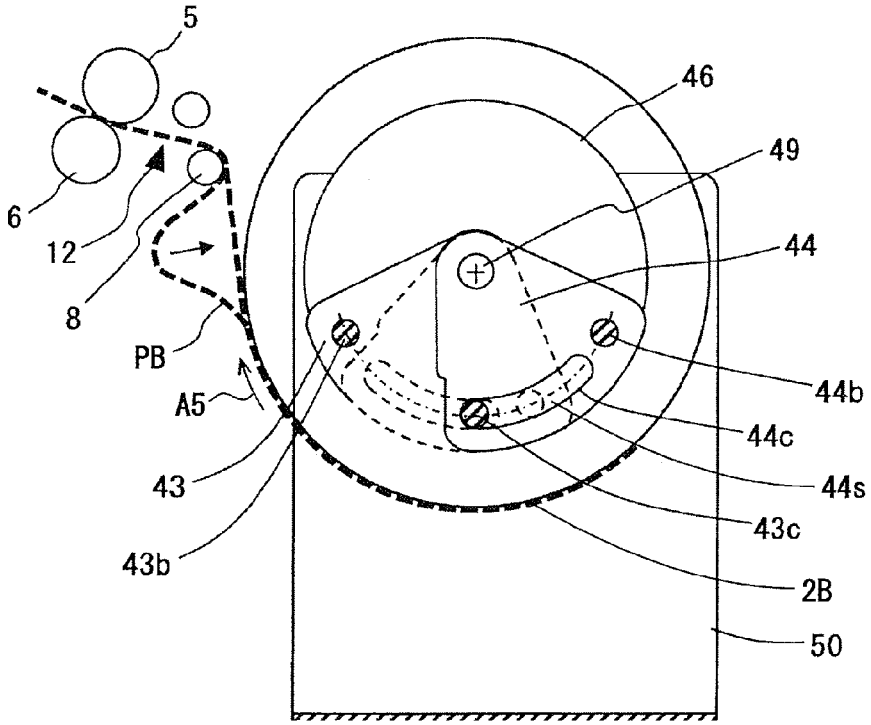

Meanwhile, the second post 44*b* is pressed against the lower end portion 56*b* of the slot wall 56 against the urging force of the torsion spring 45, because of the rotation of the tension plate 46 in the direction of arrow A5 (the shift from the state of FIG. 7A to the state of FIG. 11A) immediately after the start of conveyance. Due to the occurrence of the slack portion 71, the second post 44*b* is released from the pressure of the bent portion 46*a* of the tension plate 46, and pushes back the bent portion 46*a* of the tension plate 46 with the urging force of the torsion spring 45. This reversely rotates the tension plate 46, torque limiter 47, shaft 49, and paper roll 2B in the direction opposite to the direction of arrow A5, thereby reducing or eliminating the slack of the slack portion 71 (FIGS. 12A and 12B) occurring in the paper PB, as illustrated in FIGS. 13A and 13B.

The reverse rotation of the paper roll 2B stops when the second post 44*b* abuts the upper end portion 56*a* of the slot wall 56. Thus, if the slack is eliminated before the second post 44*b* abuts the upper end portion 56*a* of the slot wall 56, the back tension resulting from the urging force of the torsion spring 45 is applied to the paper PB; if the slack is not eliminated, the amount of slack is reduced but some slack remains in the paper PB.

Thus, in one aspect, the roll paper conveying device 1 is configured so that the amount of movement of the outer circumference of the paper roll 2B due to the reverse rotation of the paper roll 2B during movement of the second post 44*b* from the lower end portion 56*b* to the upper end portion 56*a* of the slot wall 56 is greater than the amount of slack occurring when the conveyance is stopped. FIGS. 13A and 13B illustrate a case where the slack is eliminated immediately before the second post 44*b* abuts the upper end portion 56*a* of the slot wall 56.

In this embodiment, the torsion spring 45 is used to urge the first post 43*b* and second post 44*b*, but this is not mandatory. Each of the posts 43*b* and 44*b* may be engaged with and urged by a tension spring individually.

Further, in this embodiment, the retainer gear 48 mounted to the front end portion 49*a* of the shaft 49 is directly fitted into the axle portion 3*a* of the flange 3 and they are coaxially aligned. However, this is not mandatory, and various aspects may be employed. For example, rotation of the flange 3 may be transmitted to the shaft 49 via a gear train.

Further, in this embodiment, both the back tension mechanisms 30 and 30' are movably supported by the adjustment mechanism 86. However, one of the back tension mechanisms 30 and 30' may be fixed, and the other may be movably supported by the adjustment mechanism 86.

As above, according to the roll paper conveying device of this embodiment, the paper drawn from the paper roll passes through the same conveying path regardless of whether the paper roll is an outward wound paper roll or an inward wound paper roll. This facilitates mounting of the paper roll. Specifically, in the aforementioned conventional thermal transfer printer, the damper mechanism requires different paper conveying paths for an outward wound paper roll and an inward wound paper roll This complicates mounting of a paper roll, leading to incorrect mounting. On the other hand, according to this embodiment, the back tension mechanism is connected to the axle of the paper roll. This allows the paper drawn from the paper roll to pass through the same conveying path regardless of whether the paper roll is an outward wound paper roll or an inward wound paper roll, thereby facilitating mounting of a paper roll and eliminating the aforementioned incorrect mounting.

Further, according to the roll paper conveying device of this embodiment, regardless of whether the paper roll is an outward wound paper roll or an inward wound paper roll, it is possible to apply back tension to the paper during conveyance of the paper and prevent occurrence of slack in the paper at the time of stop of the conveyance, thereby allowing the paper to be constantly stably conveyed.

Further, in the aforementioned thermal transfer printer, the damper mechanism disposed in the paper conveying path makes it difficult to downsize the printer. According to this embodiment, the back tension mechanism can be disposed outside the paper conveying path, which facilitates downsizing of the roll paper conveying device.

In the description of the above embodiment, the terms "upper" and "lower" are used for convenience of explanation and not intended to limit the absolute positional relationship in a state where the roll paper conveying device is placed. In this specification, the term "parallel" is intended to include not only completely parallel but also substantially parallel.

In the above embodiment, the roll paper conveying device is used for feeding paper from a paper roll to the printer, but may be used for other purposes. In the above embodiment, the back tension mechanism and roll paper conveying device are used for a paper roll, but may be used for other medium (or sheet) rolls. In the above embodiment, the back tension mechanism is applied to the roll paper conveying device, but applicable to a winding shaft of a rewinder, a device for winding paper or a medium (or sheet) into a roll, or other devices.

What is claimed is:

1. A back tension mechanism comprising:

a shaft configured to be connected to an axle of a rotatably supported medium roll and rotate in synchronization with rotation of the medium roll;

a rotation transmitting member connected to the shaft via a torque limiter and configured to rotate coaxially with the shaft, the rotation transmitting member having an engaging portion for transmitting rotation of the rotation transmitting member;

a first rotating member rotatably supported by the shaft, the first rotating member having a first engaged portion configured to, when the rotation transmitting member rotates in a first rotational direction, engage with the engaging portion to receive a rotational force of the rotation of the rotation transmitting member;

a second rotating member rotatably supported by the shaft, the second rotating member having a second engaged portion configured to, when the rotation transmitting member rotates in a second rotational direction opposite to the first rotational direction, engage with the engaging portion to receive a rotational force of the rotation of the rotation transmitting member;

an urging member for urging the first rotating member in the second rotational direction and urging the second rotating member in the first rotational direction; and a base rotatably supporting the shaft, the base having a first limiting portion for limiting a range of rotation of the first rotating member and a second limiting portion for limiting a range of rotation of the second rotating member.

2. The back tension mechanism of claim 1, wherein a force with which the urging member urges the first rotating member and a force with which the urging member urges the second rotating member are smaller than a force resulting from a load torque generated by the torque limiter.

3. The back tension mechanism of claim 1, wherein the urging member is a torsion spring supported by the shaft, the torsion spring having a first end urging the first engaged portion and a second end urging the second engaged portion.

4. The back tension mechanism of claim 1, wherein each of the first engaged portion and the second engaged portion is formed by a post-shaped member.

5. The back tension mechanism of claim 4, wherein the first limiting portion defines an arc-shaped slot in which the first engaged portion is fitted, and the second limiting portion defines an arc-shaped slot in which the second engaged portion is fitted.

6. A roll medium conveying device comprising the back tension mechanism of claim 1.

7. The roll medium conveying device of claim 6, wherein a flange with a shaft hole is mounted to an end of the medium roll, and the shaft is configured to rotate integrally with the flange with an end of the shaft fitted in the shaft hole.

8. The roll medium conveying device of claim 6, wherein the base is supported movably in a direction parallel to the shaft.

9. The roll medium conveying device of claim 6, further comprising a conveying unit for conveying medium drawn from the medium roll in a conveying direction while nipping the medium.

* * * * *